US005663692A

United States Patent [19]

Swope

[11] Patent Number: 5,663,692

[45] Date of Patent: Sep. 2, 1997

[54] ELECTRICALLY ACTIVATED RF SWITCH ACCESSORY USED WITH A PORTABLE RADIO

[75] Inventor: Charles B. Swope, Coral Springs, Fla.

[73] Assignee: Motorola, Inc., Schaumburg, Ill.

[21] Appl. No.: 554,430

[22] Filed: Nov. 6, 1995

[51] Int. Cl.[6] ..... H01P 1/10

[52] U.S. Cl. ..... 333/101; 333/103; 333/105

[58] Field of Search ..... 333/101, 103, 333/105, 262

[56] References Cited

U.S. PATENT DOCUMENTS

| | | | |
|---|---|---|---|
| 4,803,447 | 2/1989 | Schultz et al. | 333/103 |
| 5,060,293 | 10/1991 | Kok et al. | 333/101 X |
| 5,548,810 | 8/1996 | Riddell et al. | 455/99 |

OTHER PUBLICATIONS

Teledyne Relays, Inc. Nov. 1994 Innovations In Switching Technology, General Purpose/RF/AT Tenuator Relays pp. S 29–32.

*Primary Examiner*—Benny T. Lee
*Assistant Examiner*—Barbara Summons
*Attorney, Agent, or Firm*—Frank M. Scutch, III

[57] ABSTRACT

A radio frequency (RF) switch accessory (100) for use with a two-way radio (101) includes an input port (203), antenna port (215) for connection to an antenna and a remote port (213). The RF switch accessory (205) is used to control an electro-mechanical relay (207) for electrically connecting the input port (203) either between the antenna port (215) for connection to the radio antenna or the remote port (213). The invention allows for RF energy produced by the radio (101) to be easily switched to the remote port (213) without disconnecting an antenna from the radio.

10 Claims, 3 Drawing Sheets

ELECTRICALLY ACTIVATED RF SWITCH ACCESSORY USED WITH A PORTABLE RADIO

TECHNICAL FIELD

This invention relates in general to two-way radios and more particularly to RF switching in two-way radios.

BACKGROUND

In order to make a two-way potable radio more versatile, various accessory devices can often be used with the radio. These devices often require that radio frequency (RF) energy, which is generally emitted from the antenna, be re-routed to another port or location for use by the accessory. A typical example would be the use of a vehicular adapter. The vehicular adapter allows the portable two-way radio to be inserted into the adapter so the radio can be easily used in mobile operations.

As noted above, the use of various accessories requires some re-routing of RF energy from the antenna jack on the radio. This prevents the user from having to actually remove the radio antenna so the RF connector atop the radio can be used. In order to accomplish this redirection or re-routing of RF energy, an RF switch is used which is located on a printed circuit board in the radio. Although this switch may be either mechanical or electrical, its use presents several problems.

One problem is the switch is included in each radio during manufacture. Although this option may be seldom if ever used by a consumer, it must be built into the radio in view of the complexities in adding it afterward. Obviously, this adds unnecessary cost and expense for those users who do not require this option. Additionally, field repairs are often expensive which can add additional operating costs even for those who do require this feature.

Thus, the need exists for an external RF switch that can be used with a potable two-way radio which can eliminate the need for a switch mounted internal to the radio circuitry.

DETAILED DESCRIPTION OF THE PREFERRED EMBODIMENT

Figure 1:
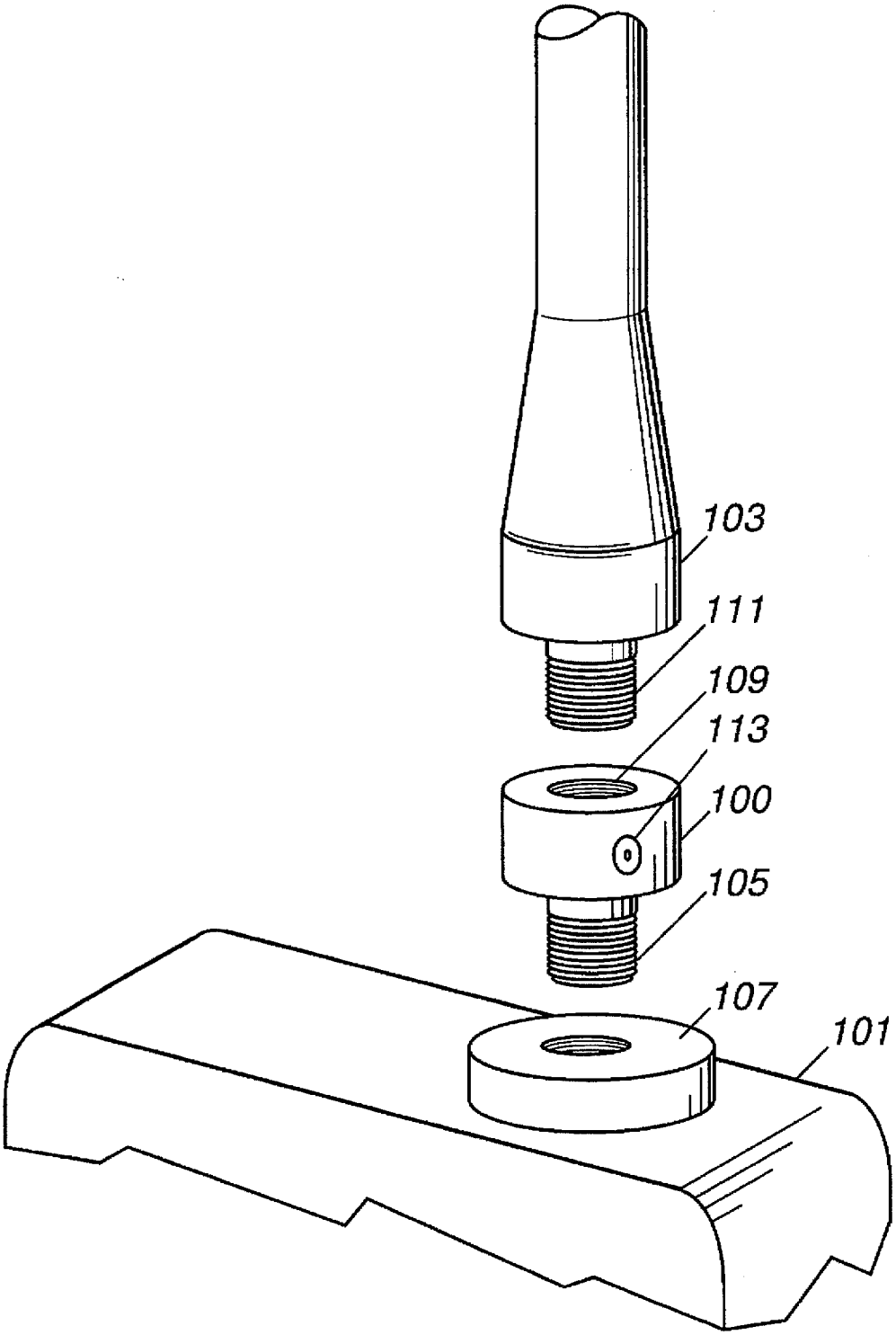
FIG. 1 is a perspective view showing the electrically activated RF switch accessory in accordance with the preferred embodiment of the invention.

Referring now to FIG. 1, the electrically activated remote RF switch accessory 100 is generally used with a portable-type two-way radio 101 and an antenna 103. The RF switch accessory 100 is shown generally in a cylindrical configuration however it will be evident to those skilled in the art that any shape is possible which may be necessary to accommodate the necessary internal electro-mechanical relays or electronics.

The RF switch accessory 100 includes a threaded member 105 which is appropriately sized and threaded to mate with and is electrically connected to a corresponding RF connector 107 located on the radio 101. Similarly, a standard port 109 comprised of an interior threaded portion is used to mate with and electrically connected to an antenna connector 111 attached to antenna 103.

Attached to the RF switch assembly 100, a remote port 113 is an electrical connector which is used to connect the RF output from the radio 101 to an external device or equipment (not shown) which may be connected thereto. Typically RF energy produced by the radio 101 is output through the RF connector 107 where it moves through the RF switch assembly 100 to be radiated by antenna 103. If during operation, the RF energy is to be redirected to the remote port 113 rather than to the antenna 103, the RF switch assembly is actuated. This is accomplished using a relay and electrical circuit (discussed hereinafter) located with the RF switch accessory 100. These components are used to switch RF energy produced by the radio 101 from the RF connector 107 to the remote port 113. In this way, the RF energy can be directed to a vehicular adapter (VA) or test equipment without the burden of providing adapters or couplers from the standard port 109.

Figure 2:
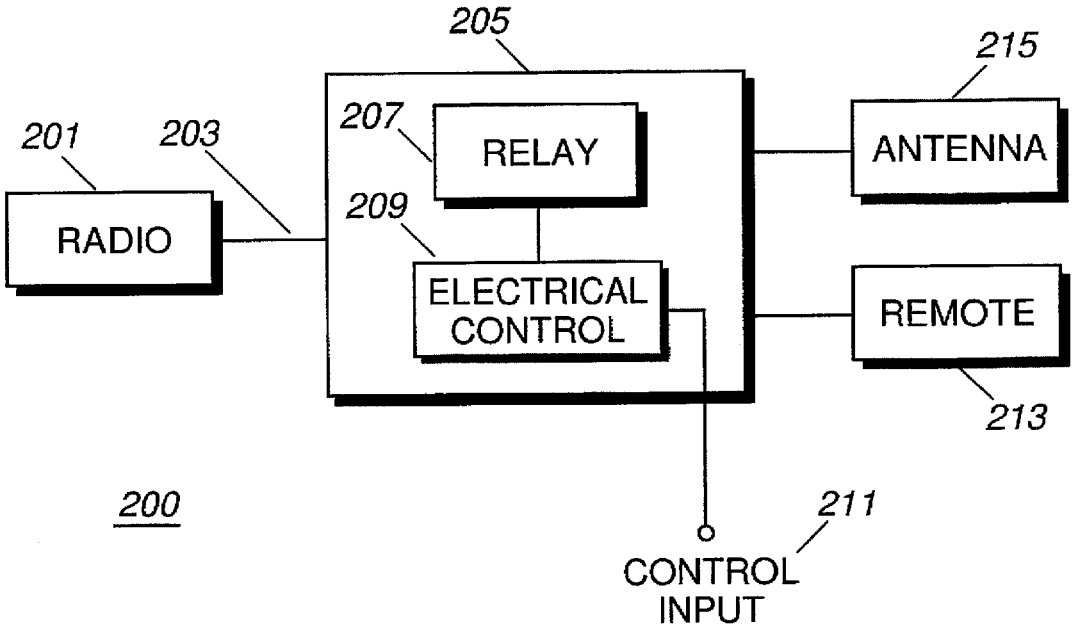
FIG. 2 is a block diagram of the RF switch accessory shown in FIG. 1.

In FIG. 2, a block diagram 200 is shown depicting general operation of the RF switch assembly 100 as seen in FIG. 1. As noted above, the radio 201 provides an RF output which is directed to an input port 203 on the RF switch accessory 205. The RF switch accessory 205 includes an RF relay 207 and electrical control circuit 209 which is used for switching and controlling the relay 207. Depending on the state of the control input 211, the relay 207 is switched and connects the RF output 203 to either the remote port 213 or the antenna port 215.

Figure 3:
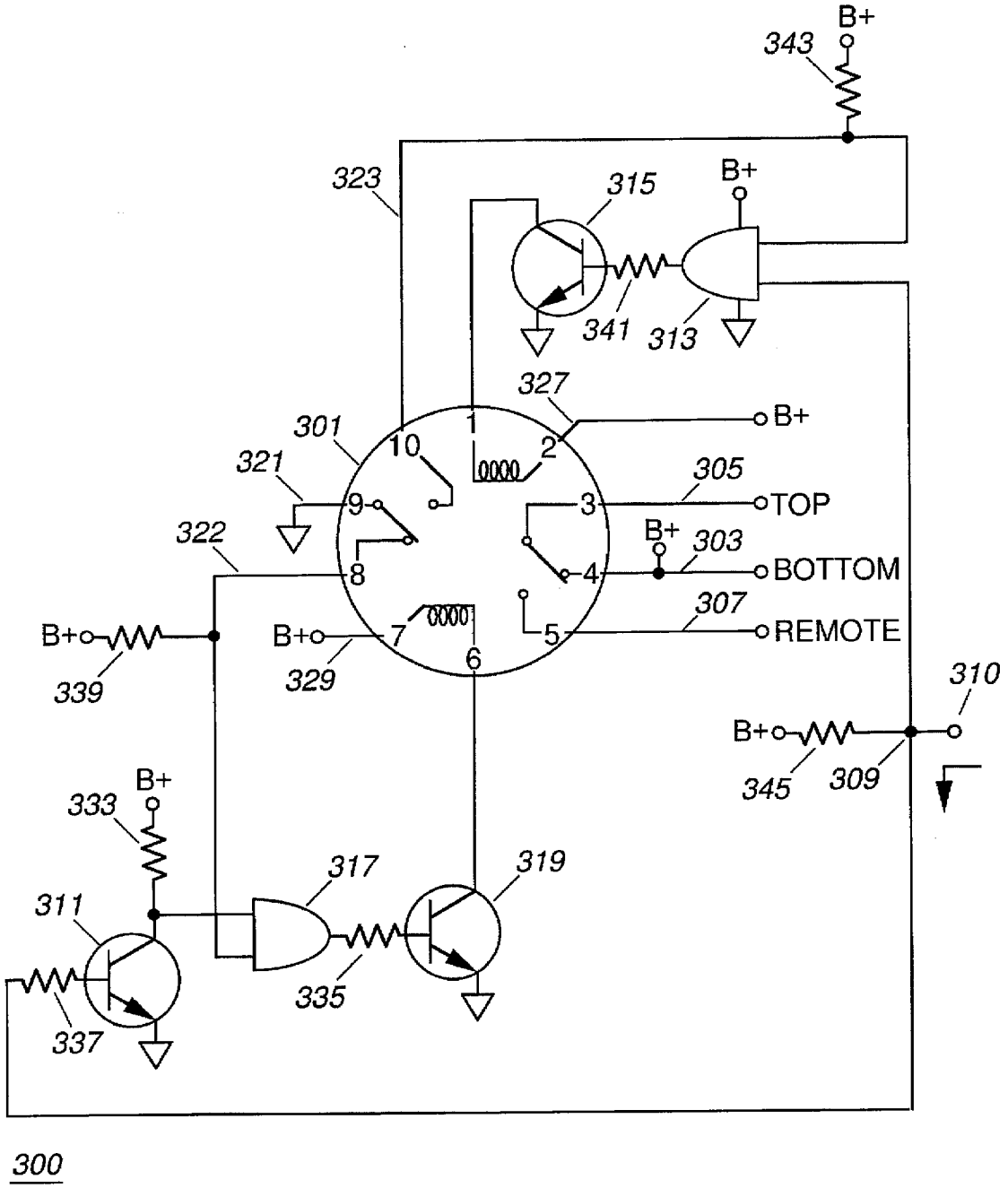
FIG. 3 is a schematic diagram showing the switching circuit according to a preferred embodiment of the invention.

In FIG. 3, a schematic diagram is shown depicting connections of the various components used in the RF switch assembly 100 according to a preferred embodiment of the invention. The switching circuit 300 includes a relay 301 which is used to switch an RF signal appearing at an input 303 between a primary output 305 and a remote output 307. By way of example, the relay 301 may be manufactured by Teledyne—Series 722-Double pole Double throw (DPDT) Latching Relay. Although used in the preferred embodiment of the invention, it should be evident to those skilled in the art that any equivalent RF switching relay may be used.

In it's normal state, the relay 301 includes a plurality of internal relay contacts 1–10 and connects the input 303 to the primary output 305. In regular operation, an antenna 103, as seen in FIG. 1, is connected to the primary output 305. Thus, RF energy emanating from a radio, passes through the relay 301 where it is radiated by an antenna. In the event, a user of the radio is desirous of directing the RF energy from the primary output 305 to the remote output 307, the relay 301 must be actuated. Hence, one portion of the relay 301 is used to switch RF energy to various locations while the other portion is used to switch a sensing circuit used to detect the logic state in which the electronic switching circuit controls relay 301.

In order to actuate the relay 301 it will be necessary to provide an actuating voltage to the various electrical components used to control the relay 301. Although a separate external voltage could be supplied through a separate voltage port (not shown) to each of these components where necessary, the preferred method utilizes the input 303 along with the RF energy supplied by the radio. This is done by superimposing the RF energy at the desired frequency upon a DC voltage of a predetermined amplitude. The DC voltage can be used to drive the various components in the switch circuit without effecting the RF energy which is supplied by the radio. This DC voltage is applied at switch contacts 303, 327 and 329. This technique is advantageous since a separate voltage source does not be provided and one RF connector can be used to couple both RF energy and voltage to the switching circuit 300. It will also be evident to those skilled in the art, that any filtering or voltage attenuation that may be required can be accomplished through common filtering techniques so as any circuitry or components located within relay 301 will not be damaged.

When the relay 301 is to be actuated, a special connector 310 or other actuation means may be provided at the remote output 307. This allows a voltage to be applied to the various components of the switching circuit. When a logic voltage is applied to a sensing port 309, depending on the logical state applied, either the standard antenna port driver transistor 315 or the remote port driver will be actuated. This is accomplished by two complimentary logic circuits consisting of an inverter 311, two logical AND gates (317, 313), and state detection switch contacts (321, 322, 323) located in the relay 301. These components act as a detection circuit to detect the presence of a connection to the remote output 307.

In operation, if the state of the sensing port 309 matches the state detection switch contacts (321,322,323), and a voltage is applied to the input 303—no switching occurs. Conversely, if the state of the sensing port 309 does not match the state detection switch contacts (321, 322, 323) then switching does occur. In the case where the sensing port 309 is connected (logical low), its signal is seen by a standard port AND gate 313 and an inverter 311. The state detection switch contacts (321, 322, 323) states are logically combined or "ANDed" together with the state and inverted state of the sensing port 309.

If the standard port state (contact 321 connected to contact 323) were the initial state activated in the state detection switch contacts (321, 322, 323), and the sensing port 309 maintains a logical low, and a predetermined DC voltage is applied to the input 303, the remote port AND gate 317 turns on the remote port drive transistor 319 actuating the relay 301. This has the effect of directing the RF energy from the input 303 to the remote output 307. After the RF energy is switched, the state detection switch contacts (321, 322, 323) sets its new state to be the remote port state (contact 321 connected to contact 322). The logical low state of the sensing port 309 shuts off the standard port AND gate 313 and disables this portion of the circuit. This process is then repeated when the sensing port 309 is a logical high using the standard port logic AND gate 313 and the standard port drive transistor 315, while, the inverter 311 shuts off the remote port AND gate 317.

Resistors 335, 337, and 341 are biasing resistors to prevent over loading the switching transistors. The remaining resistors, 333, 339, 343, and 345 are biasing resistors used to determine the operating state of the transistors.

The preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A radio frequency (RF) switch accessory used with a two-way radio comprising:

a housing for attaching to an RF output located on the two-way radio, the housing including an antenna port and a remote port; and an electrical circuit located within the housing and including a double-pole double-throw (DPDT) relay for electrically connecting the RF output between the antenna port and the remote port.

2. A RF switch accessory as in claim 1 wherein the electrical circuit further includes a detection circuit for sensing a presence of an electrical connection to the remote port.

3. An accessory used with a two-way portable radio for switching RF energy from an input port to either a primary port or a remote port comprising:

a housing;

at least one double-pole double-throw (DPDT) relay for switching RF energy from the primary port to the remote port;

a switching circuit for sensing an operating state of the at least one relay and controlling switching operation of the at least one relay in response to a control input provided to the accessory; and wherein the at least one DPDT relay and the switching circuit are located with the housing.

4. An accessory as in claim 3 wherein the switching circuit includes a plurality of logic gates for determining a switching state of the at least one relay.

5. An accessory as in claim 3 wherein the control input is integrated into the remote port.

6. An accessory as in claim 3 wherein a voltage used to drive the switching circuit and the at least one relay is superimposed upon the RF energy supplied from the two-way portable radio.

7. An accessory as in claim 3 wherein the switching circuit senses an electrical connection to the remote port.

8. A switching device used with a two-way radio comprising:

housing including an input port, output port and remote port;

a double-pole double-throw (DPDT) electro-mechanical switch located within the housing for switching the input port between the output port and the remote port; and wherein a voltage used to operate the electro-mechanical switch is supplied by superimposing a voltage upon RF energy supplied by the two-way radio to the input port.

9. The switching device as in claim 8 further comprising:

a sensing circuit for detecting a presence of an electrical connection to the remote port.

10. The switching device as in claim 8 wherein the electro-mechanical switch is located within the housing for utilizing the device as a two-way radio accessory.

* * * * *